US005384993A

United States Patent [19]

Phillips

[11] Patent Number: 5,384,993

[45] Date of Patent: Jan. 31, 1995

[54] TIE DOWN FOR BUILDING STRUCTURES

[76] Inventor: Belton R. Phillips, Rte. 1, Box 1876, Fred King Rd., Hartwell, Ga. 30643

[21] Appl. No.: 152,425

[22] Filed: Nov. 15, 1993

[51] Int. Cl.[6] ..... E04H 9/14; E02D 27/50

[52] U.S. Cl. ..... 52/92.2; 52/223.6; 52/293.3; 52/DIG. 11; 52/295

[58] Field of Search ..... 52/295, 293.3, 698, 52/149, DIG. 11, 223.4–223.7, 23, 92.2; 248/499, 400

[56] References Cited

U.S. PATENT DOCUMENTS

| | | | |
|---|---|---|---|
| 269,018 | 12/1882 | Crowell et al. | 52/23 |
| 573,452 | 12/1896 | Delahunt | 52/92.2 |
| 777,441 | 12/1904 | Small | 52/23 |
| 1,864,403 | 6/1932 | Bradley | 403/213 |
| 2,165,500 | 7/1939 | Muirhead | 52/293.3 X |
| 3,054,151 | 9/1962 | Shankland | 52/23 |
| 3,335,531 | 8/1967 | Grimelli et al. | 52/DIG. 11 X |
| 3,724,151 | 4/1973 | Kaywood et al. | 52/295 |
| 3,726,054 | 4/1973 | Anderson et al. | 52/148 |
| 3,802,138 | 4/1974 | McCarler | 52/DIG. 11 X |
| 3,828,491 | 8/1974 | Koon et al. | 52/DIG. 11 X |
| 3,852,931 | 12/1974 | Morse et al. | 52/293.3 |
| 3,894,365 | 7/1975 | Abbott | 52/23 |
| 3,937,436 | 2/1976 | Stewart | 248/499 |
| 3,943,670 | 3/1976 | Miller | 52/23 |
| 4,018,015 | 4/1977 | Swanson | 52/DIG. 11 |
| 4,068,426 | 1/1978 | Warren | 52/DIG. 11 X |
| 4,272,933 | 6/1981 | Lopes | 52/149 |
| 4,321,776 | 3/1982 | Delight | 52/295 X |
| 4,688,362 | 8/1987 | Pedersen et al. | 52/223.7 |
| 5,007,218 | 4/1991 | Bengston et al. | 52/295 X |

*Primary Examiner*—Carl D. Friedman
*Assistant Examiner*—Robert J. Canfield
*Attorney, Agent, or Firm*—Hopkins & Thomas

[57] ABSTRACT

An apparatus for tying down and anchoring a building structure such as a mobile home (12). The apparatus comprises an elongated threaded rod assembly (16) which is anchored at its lower end (34) to a concrete base (14) and extends upwardly, first through the floor joist (22) and then up to the roof structure where it is connected to the rafters (48). The elongated rod assembly (16) includes a hold-down block (32) that connects upper threaded rod (30) and lower threaded road (28) together in an end-to-end relationship. The hold-down block (32) applies a downward force firmly holding the floor joist (22). The upper threaded rod 30 extends upwardly through a frame board (26) and an elongated bracket (40). An internally threaded lock-block (46) is screwed onto the end of the upper threaded rod (30) extending past the frame board (26) and bracket (40), firmly holding the roof structure.

13 Claims, 4 Drawing Sheets

TIE DOWN FOR BUILDING STRUCTURES

FIELD OF THE INVENTION

The present invention relates to a method and apparatus for tying down and anchoring a bulldog structure such as a mobile home, thereby providing improved stability and rigidity.

BACKGROUND OF THE INVENTION

Mobile homes and like structures such as temporary or portable buildings are widely used because of their low cost and ability to be moved from one location to another. An inherent downfall of mobile homes is their structural instability because they are not constructed upon nor fixed to a foundation as are permanent structures, but are merely placed on blocks or jacks. Consequently, the aforementioned structures are susceptible to damage or destruction from high speed winds, surface vibrations, movement of occupants, or other similar forces.

In an effort to add structural stability to mobile homes, several types of tie down and anchoring apparatuses have evolved. U.S. Pat. No. 3,724,151 to Kaywood et al. discloses a mobile home anchoring apparatus having one end clamped to the mobile home underframe and the opposite end embedded in a concrete base. As Kaywood provides a means for linearly adjusting the tension of the anchoring apparatus in the form of a turnbuckle and chain. Lopes, U.S. Pat. No. 4,272,933, discloses a mobile home anchor which is similar to Kaywood but which eliminates the necessity of welding the loops of the eye bolts closed in the Kaywood structure without sacrificing strength. This is achieved by means of a first clevis bolted to the base and a second clevis attached upwardly to the legs of the base clevis.

However, the anchoring type devices such as disclosed in Kaywood and Lopes only attached to the under frame of the mobile homes and did not add any stability to the vertical walls or roof of the structure. Moreover, the mobile homes must have an under frame compatible with the clamping means disclosed in Kaywood and Lopes for those anchors to be properly attached to the frame.

Alternatively, tie down type devices are disclosed in U.S. Pat. No. 3,335,531 to Grimelli et al. and U.S. Pat. No. 3,726,054 to Anderson et al. Grimelli discloses an exteriorly mounted tie down system having a cross rod connected at each end to corner brackets positioned on opposite sides of the mobile home and a brace rod extends downwardly from each bracket and attaches at its lower end to hooks embedded in a concrete base. Additionally, Grimelli teaches the connection of the mobile home underframe to the hooks by means of a securing rod. Similarly, Anderson discloses an apparatus having a continuous cable positioned over the mobile home and anchored at each end on opposite sides of the mobile home.

The tie down type apparatus of the types disclosed in Grimelli and Anderson add stability to the vertical walls and roof of mobile homes but must be mounted on the exterior of the mobile homes.

Accordingly, it can be seen that it would be desirable to provide an apparatus for stabilizing and securing structures such as mobile homes which offers stability to both the underframe and vertical side members of the mobile home while remaining hidden from site.

SUMMARY OF THE INVENTION

Briefly described, the present invention comprises a method and apparatus for securing and tying down building structures such as mobile homes to the earth or foundation upon which they rest. The apparatus for tying down mobile homes includes an elongated threaded rod assembly which is anchored at its lower end to a concrete base and extends upwardly, first through the floor joist and then up to the roof structure where it is connected to the rafters or other roof structures.

The elongated threaded rod assembly is comprised of a lower and a upper rod segment. The lower rod segment has its lower end embedded in a concrete base and its upper end extending through the floor joist of the mobile home and is internally threaded into the bottom of a hold-down block. This portion of the rod assembly anchors the mobile home by its frame, securing it to the foundation upon which it rests. A feature of the present invention is that the lower rod segment may function alone as an anchoring system without installing the upper rod segment, thereby offering great versatility.

The upper segment of the rod assembly has its lower end threaded into the top of the hold-down block and its upper end extending upwardly through openings in a roof beam and bracket. The bracket is an elongated member which extends over the upper surfaces of the rafters and roof beams. An internally threaded lock block is screwed onto the end of the upper rod segment extending past the roof beam and bracket. This portion of the rod system adds stability to the vertical walls and roof structure of a mobile home without having to exteriorly mount a system which would hamper the visual appeal of the structure and eventually weaken over time from the corrosive effect of nature. The present invention avoids these inadequacies by mounting the rod assembly in the interior space between the exterior and interior walls of the mobile home.

Accordingly, it is an object of the present invention to provide an improved apparatus for tying down and securing portable buildings such as mobile homes.

Another object of the present invention is to provide a tie down apparatus which does not detract from aesthetical value of the structure which it secures.

Another object of the present invention is to provide a tie down apparatus which is versatile in operation and which has improved securing capabilities, and is economical and easy to install.

Other objects, features and advantages of the present invention that can be understood from a review of the following specification when taken in conjunction with the accompanying drawings.

DETAILED DESCRIPTION OF THE PREFERRED EMBODIMENT

Figure 1:
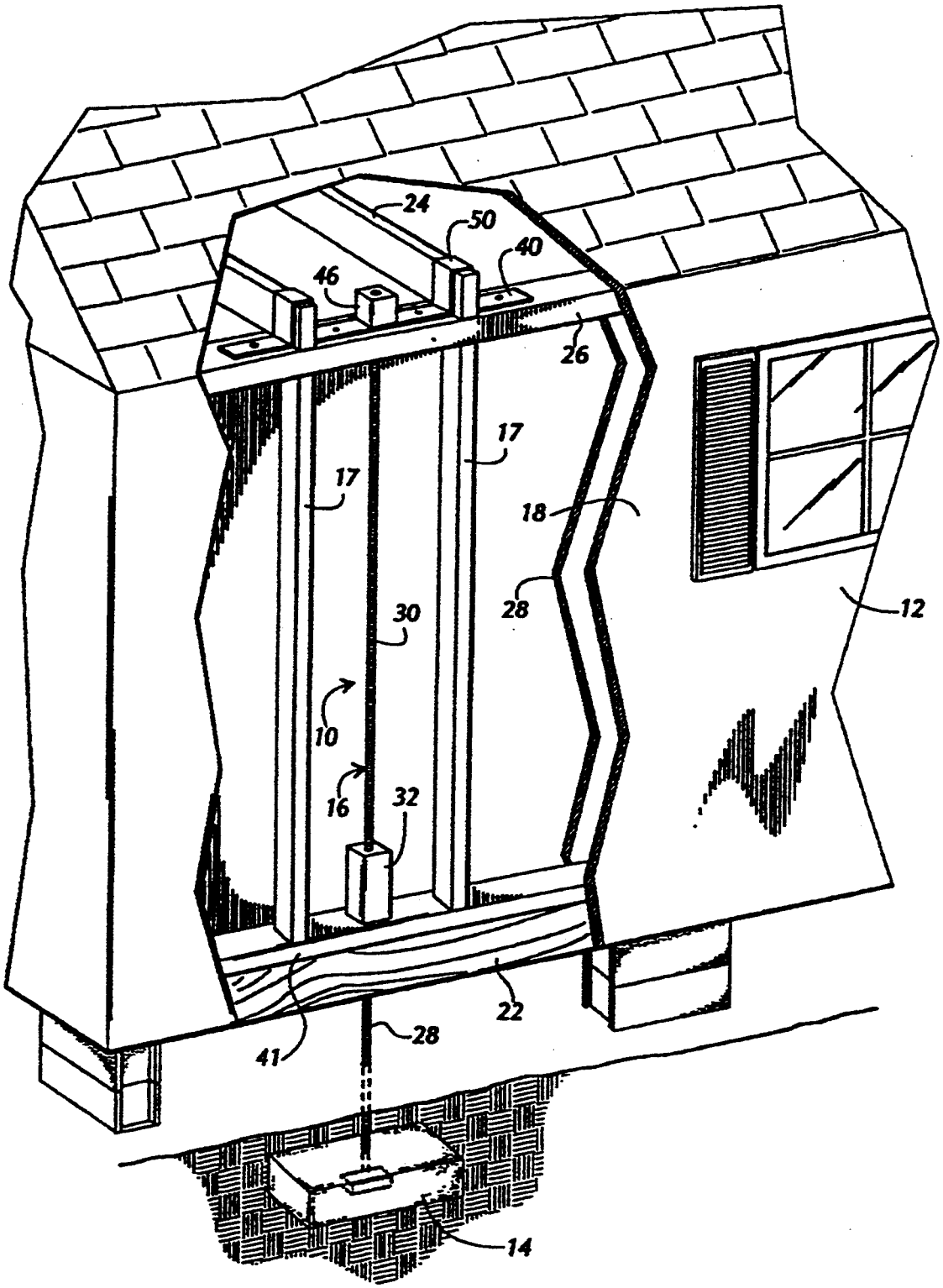
FIG. 1 is a perspective cut away view of the tie down apparatus for securing portable buildings such as a mobile home.

Referring now in greater detail to the drawings, FIG. 1 illustrates a tie down apparatus 10 for anchoring a building structure 12, such as a mobile home or other portable building not anchored to the ground. The building structure typically has a floor structure mounted on a supporting frame which is suspended above the ground surface by concrete blocks, etc., and a roof structure suspended by studs, etc., over the floor structure. Tie down apparatus 10 includes an elongated threaded rod assembly 16 disposed in the space defined by an exterior facade 18 and an interior facade 20 of the building structure and an anchoring means such as concrete base 14 which usually is cast in place, in the ground and covered with soil, etc. The rod assembly extends through a floor joist 22 between wall studs 17 and upwardly to the roof beam 26. The elongated threaded rod assembly 16 includes a lower threaded rod 28 and upper threaded rod 30, connected together in end-to-end relationship by hold-down block 32. Lower and upper threaded roads, 28 and 30 respectively, are preferably made of steel or the equivalent.

Figure 2:
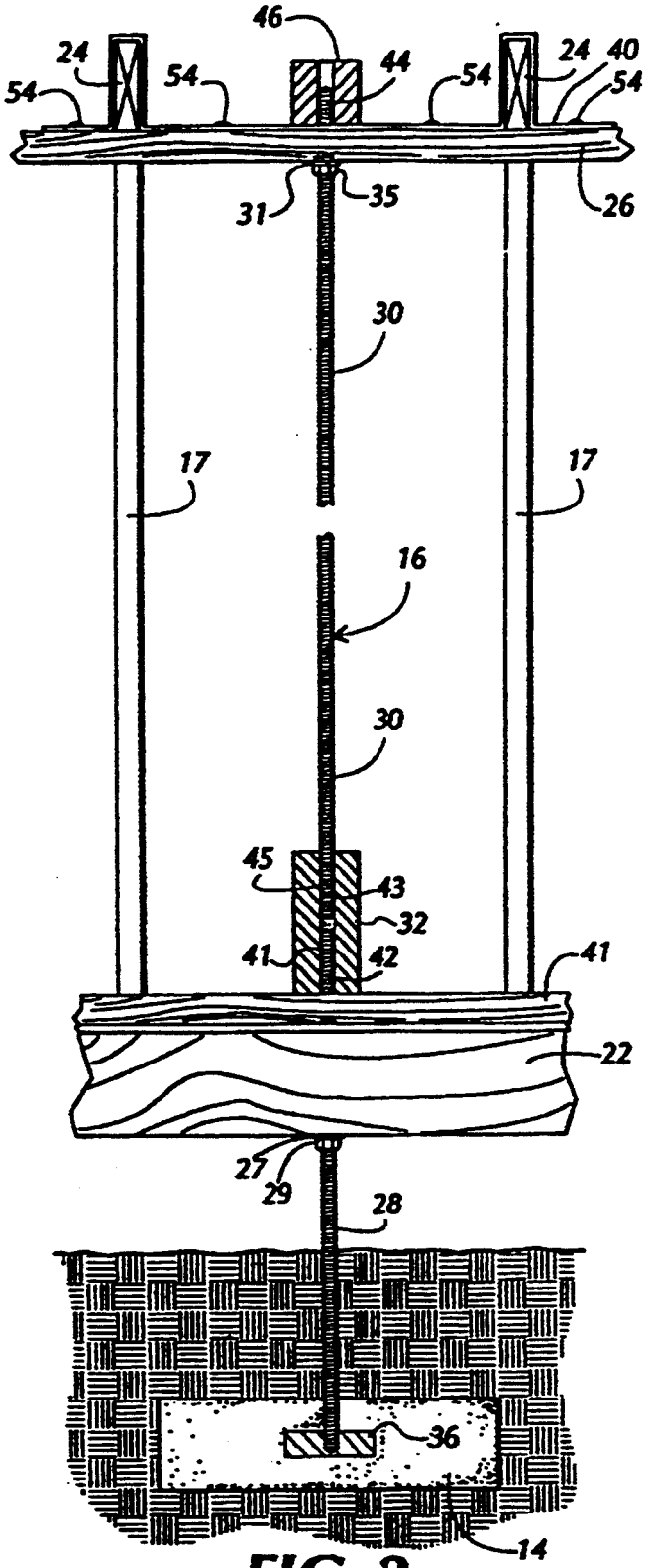
FIG. 2 side elevational view of the tie down apparatus for securing portable buildings such as mobile homes.
Figure 3:
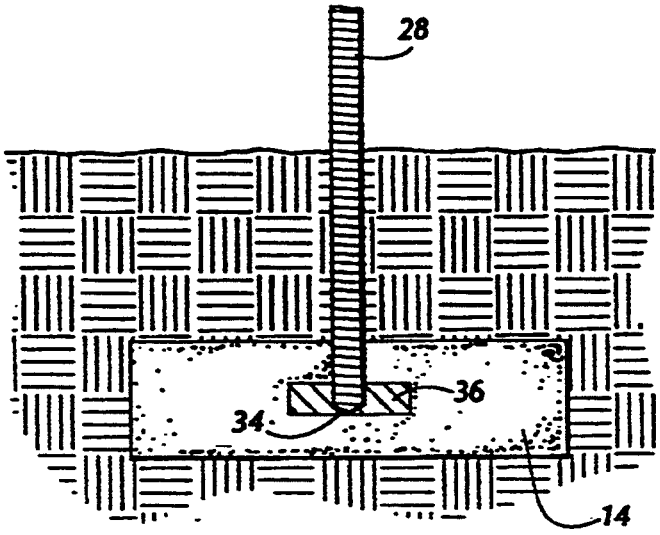
FIG. 3 is a detail of the base of the anchor structure.

As FIG. 2 illustrates, lower rod 28 is threaded at both ends, the lower end 34 being threaded into an anchor connection means such as base plate 36. The base plate and lower portion of lower threaded rod 28 are embedded in concrete base 14. Concrete base 14 may be disposed at ground level, or alternatively, submerged below the earth's surface and covered with soil, etc. as shown in detail in FIG. 3. Lower threaded rod 28 extends upwardly from concrete base 14, through opening in the floor joist 22 and the floor beam 41. A bolt 29 threaded onto lower threaded rod 28 and spacing means, such as washer 27, are disposed adjacent to the bottom surface of floor joist 22. The upper end 42 of lower threaded rod 28 extending above floor beam 41 is threaded into a floor connector means such as the hold-down block 32.

Figure 4:
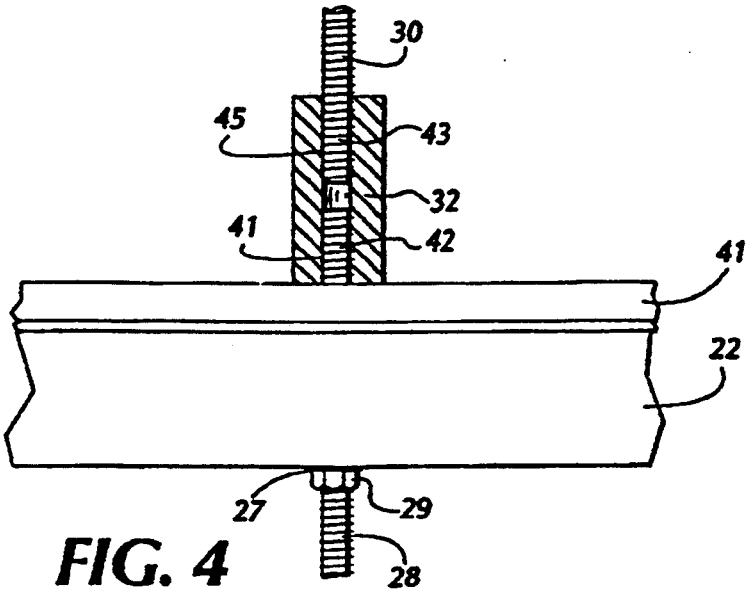
FIG. 4 is a detail of the hold down block.

As illustrated in FIG. 4, the hold down block 32 has internally threaded bores, threaded bore 41 facing downwardly for receiving the upper end 42 of lower threaded rod 28, and threaded bore 45 facing upwardly for receiving the lower end 43 of upper threaded rod 30. Threaded bores 41 and 45 sham the same central axis, though in an alternative embodiment the threaded bores 41 and 45 can be disposed side by side, having parallel axes.

The upper rod 30 is threaded at both ends, the lower end 43 being threaded into hold-down block 32 and the upper end extends upwardly through roof beam 26 to a roof connection means such as elongated bracket 40. The portion of upper rod 30 extending past roof beam 26 and elongated bracket 40 is threaded into a lock block 46. As illustrated in FIG. 2, a bolt 35 threaded onto upper threaded rod 30 and a spacing means, such as washer 31, are disposed adjacent the bottom surface of roof beam 26.

Figure 5:
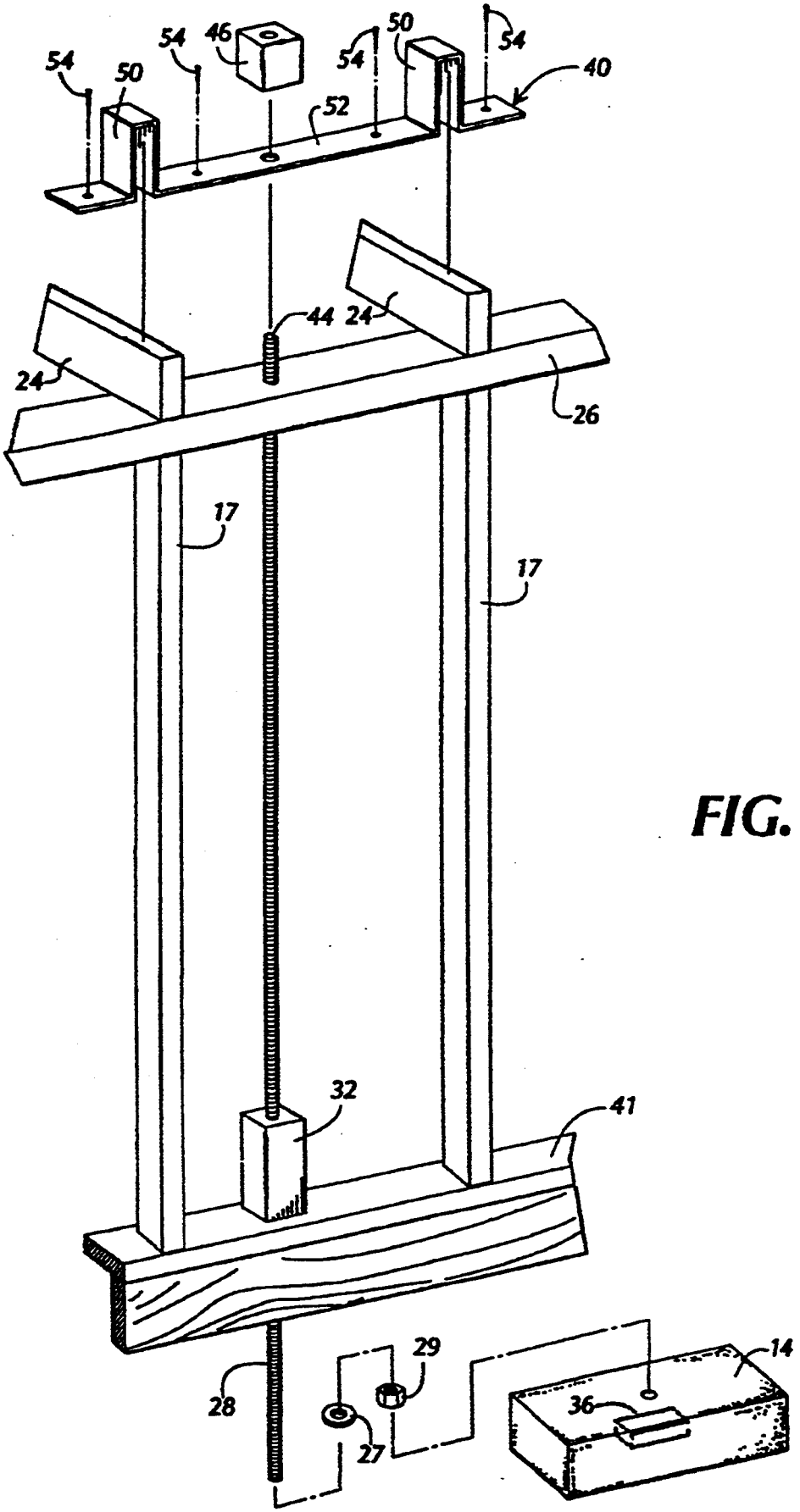
FIG. 5 is an exploded perspective view of the tie down apparatus, substantially illustrating the overlapping segments of the bracket and rafters.

FIG. 5 shows the overlapping engagement of elongated bracket 40 and the rafters 24. Bracket 40 has a plurality of outwardly projecting protrusions 50 which are spaced apart and sized and shaped so as to fit over rafters 24 with connecting spans 52 therebetween. When the bracket 40 has its protrusions fitted on rafters 24, the lower spans 52 between the protrusions lie flush against the upper surface of roof beam 26, and are fastened thereto by conventional means such as nails 54. The upper end 44 of upper threaded rod 30 protrudes through an opening in bracket 40 and is threaded into lock block 46.

It can be understood from the description above and the accompanying illustrations that the tie down functions as a hold down to resist the lifting forces created by negative air pressure resulting from wind traveling across the roof of the building structure. Additionally, the tie down functions a hold down to resist lateral movement at the base of the building structure.

If the mobile home or other building structure 12 has an obstruction, such as a window, electrical wiring, or plumbing, which is not suitable for the installation of the upper rod 30, the upper rod and its brackets 40 can be eliminated and the lower rod 28 may be used with the hold down block 32 and base 14 to hold down and secure the lower frame of the building structure 12.

Although the invention has been shown in a preferred form thereof, it should be understood that numerous changes, modifications, additions and deletions may be made thereto without departure from the spirit and scope of the invention as set forth in the following claims.

I claim:

1. A tie down assembly for a building structure having a floor structure suspended above the ground and a roof structure including rafters suspended over the floor structure, said tie down assembly comprising:

anchor means for mounting in the ground beneath the floor structure, a tie down rod assembly mounted at a lower end thereof to said anchor means for extending upwardly from said anchor means past the floor structure and to the roof structure, said tie down rod assembly including a floor connector for positioning substantially above the floor structure and engaging and holding the floor structure downwardly against lifting forces and a roof connector for engaging and holding the roof structure downwardly against lifting forces.

2. The tie down assembly of claim 1 and wherein said anchor means includes a hold down member embraced in concrete and a threaded segment for receiving said tie down rod assembly;

wherein said tie down rod assembly includes at its lower end a lower rod segment including anchor connection means for connection to said threaded segment of said hold down member, and adapted to extend upwardly from said hold down member to the floor structure of the building structure, and wherein said floor connector comprises a floor hold down means connected to said lower rod segment for anchoring said floor structure to said anchor means, said tie down rod assembly further including an upper rod segment adapted to extend upwardly from said floor connector to said roof structure, and wherein said roof connector comprises roof hold down means connected to said upper rod segment for anchoring said roof structure to said anchor means.

3. The tie down assembly of claim 2 and wherein said floor connector comprises a block with rod connector means for connection to said lower and upper rod segments, whereby said tie down rod assembly is adapted to pass through the building structure.

4. The tie down assembly of claim 2 and wherein said roof hold down means comprises bracket means for spanning at least adjacent ones of the rafters of the roof structure.

5. The tie down assembly of claim 2 and wherein said roof hold down means comprises means for engaging and holding down the rafters of the roof structure.

6. The tie down assembly of claim 1 and wherein the building structure to which said tie down assembly is to be attached includes a wall structure having an outside facade and an inside facade spaced from the outside facade and defining an interior space between the outside and inside facades, and wherein said tie down assembly is adapted to extend upwardly through the interior space of the wall structure.

7. The tie down assembly of claim 2 and wherein said floor connector comprises a hold down block threadedly connected to said lower and upper rod segments.

8. A tie down assembly for a building having a floor structure spaced from the ground and a roof structure including rafters spaced above the floor structure, said tie down assembly comprising:

an anchor for mounting in the ground beneath the building structure;

an elongated tie down rod assembly for mounting in an upright attitude and for extending through the floor structure to the roof structure and connected at its lower end to said anchor;

roof connecting means connected in the upper end of said tie down rod assembly and for connection to the roof structure;

a floor connector coupled to said tie down rod assembly for positioning over and engaging and holding down the floor structure; and whereby the tie down assembly is adapted to resist upward movements of the floor structure and the roof structure of the building.

9. The tie down assembly of claim 8 and wherein said floor connector is a block having a threaded longitudinal bore.

10. The tie down assembly of claim 8 and further comprising a bolt and a spacer means coupled to the lower portion of said tie down rod assembly for positioning below the floor structure and for engaging the floor structure.

11. The tie down assembly of claim 8 and further comprising a bolt and spacer means coupled to the upper portion of said tie down rod assembly for positioning below the rafters of the roof structure and for engaging the roof structure.

12. A tie down assembly for a building having a floor structure suspended above the ground and a roof structure suspended over the floor structure, said tie down assembly comprising:

anchor means for mounting in the ground beneath the floor structure;

a tie down rod assembly including tie rod means for mounting in an upright attitude having a lower end portion connected to said anchor means and for extending upwardly through said floor structure;

a hold down block mounted to said tie rod means for positioning above and for engaging with the floor structure to hold the floor structure down against lifting forces;

a roof connector for connection to the roof structure, said roof connector being attached to the upper portion of said tie rod assembly to hold the roof structure down against lifting forces;

lower bolt means attached to said tie rod means for positioning below and adapted to engage the floor structure;

Upper bolt means attached to said tie rod means for positioning below and adapted to engage the roof structure; and whereby the tie rod assembly is adapted to resist vertical movements of the floor structure and the roof structure of the building.

13. The tie down assembly of claim 12 and wherein said tie rod means comprises a lower rod and an upper rod, said lower and upper rods being threadedly connected to said hold down block.

* * * * *